US011873708B2

(12) United States Patent
Liang

(10) Patent No.: US 11,873,708 B2
(45) Date of Patent: Jan. 16, 2024

(54) OPTIMIZING BOREHOLE ULTRASONIC CEMENT EVALUATION USING ADAPTIVE BEAM-FORMING WITH ARRAY TRANSDUCER

(71) Applicant: Halliburton Energy Services, Inc., Houston, TX (US)

(72) Inventor: Kenneth Kin-nam Liang, Stow, MA (US)

(73) Assignee: Halliburton Energy Services, Inc., Houston, TX (US)

( * ) Notice: Subject to any disclaimer, the term of this patent is extended or adjusted under 35 U.S.C. 154(b) by 260 days.

(21) Appl. No.: 17/447,632

(22) Filed: Sep. 14, 2021

(65) Prior Publication Data

US 2022/0251940 A1 Aug. 11, 2022

Related U.S. Application Data

(60) Provisional application No. 63/146,027, filed on Feb. 5, 2021.

(51) Int. Cl.
*E21B 47/002* (2012.01)
*E21B 47/005* (2012.01)

(52) U.S. Cl.
CPC ..... *E21B 47/0025* (2020.05); *E21B 47/005* (2020.05)

(58) Field of Classification Search
CPC .. E21B 47/0025; E21B 47/005; E21B 47/085; E21B 47/00; E21B 47/01; E21B 47/09; E21B 47/06; E21B 47/095; E21B 47/107; E21B 47/14; E21B 47/16; E21B 47/0224; E21B 47/022; E21B 47/007;
(Continued)

(56) References Cited

U.S. PATENT DOCUMENTS 5,469,736 A * 11/1995 Moake ..... E21B 47/085 73/152.58
2012/0224455 A1* 9/2012 Dorovsky ..... G01V 1/50 367/35

(Continued)

FOREIGN PATENT DOCUMENTS

EP 646697 A1 * 4/1995 ..... E21B 47/082
EP 3179277 A1 * 6/2017 ..... E21B 47/0005
WO WO-2019232647 A1 * 12/2019 ..... E21B 43/14

OTHER PUBLICATIONS

"Field Test Results of a New High-Resolution, Dual-Physics Logging-While-Drilling Imaging Tool in Oil-Base Mud," Maeso, C.J. et al., SPWLA 59th Annual Logging Symposium, London, UK, Jun. 2-6, 2018, pp. 1-17. (Year: 2018).*

(Continued)

*Primary Examiner* — Jeffrey P Aiello
(74) *Attorney, Agent, or Firm* — DeLizio, Peacock, Lewin & Guerra, LLP

(57) ABSTRACT

A downhole tool can be deployed having an acoustic transducer array having a plurality of electroacoustic elements disposed circumferentially about the downhole tool, i.e., arrange in a circular shape. The acoustic transducer array can operate by activating active apertures to create synthesized acoustic pulses and receive the pulses' echoes, i.e., acoustic reflections, and then, in cooperation with one or more processors, create a 360° image of the casing and material behind the casing.

20 Claims, 6 Drawing Sheets

(58) Field of Classification Search
CPC . E21B 49/00; G01V 1/50; G01V 1/30; G01V 1/44; G01V 1/48; G01V 1/40; G01N 2291/044; G01N 2291/02854; G01N 29/46; G01N 29/07; G01N 29/348; G01B 17/02
USPC ..... 73/602, 152.01, 152.03, 152.19, 152.46, 73/152.54, 598, 606, 628, 624, 632, 73/152.57, 589, 801; 166/254.2, 250.01; 181/105, 104, 102; 367/35, 38, 21, 86, 367/83, 129, 31, 72, 82, 13; 702/12, 6, 702/17, 9, 7, 39, 150, 182, 189, 48, 1, 702/103, 152, 104
See application file for complete search history.

(56) References Cited

U.S. PATENT DOCUMENTS

2016/0216393 A1* 7/2016 Zhou ..... E21B 47/0025
2017/0090057 A1* 3/2017 Thierry ..... E21B 47/005
2017/0168179 A1* 6/2017 Lemarenko ..... E21B 47/005

OTHER PUBLICATIONS

"EP Application No. 2117896.7 Search Report", dated May 25, 2022, 1 page.

* cited by examiner

OPTIMIZING BOREHOLE ULTRASONIC CEMENT EVALUATION USING ADAPTIVE BEAM-FORMING WITH ARRAY TRANSDUCER

RELATED APPLICATION

This application claims the benefit of priority to U.S. Provisional Application Ser. No. 63/146,027, filed Feb. 5, 2021, the entire contents of which is incorporated by reference herein.

TECHNICAL FIELD

The disclosure generally relates to surveying of boreholes or wellbores and monitoring or checking cementation quality or levels.

BACKGROUND

Ultrasonic cement evaluation tools can operate in pulse-echo mode where a single transducer serves as both transmitter and receiver. Typically, a broad-band incident pulse is emitted from the single transduce which impinges on the inner surface of a casing in a wellbore. The incident pulse excites the half-wave resonance in the casing which can result in a decaying ring down signal. The time decay rate depends on the acoustic impedance of the material (typically cement) in the annular space between the outside surface of the casing and the formation. The ring-down waveform is typically processed using an inversion algorithm to quantitatively determine the acoustic impedance of the annular material as a physical indication of the presence or absence of cement (and also the quality of the cement). The inversion algorithm is typically based on a 1-D physics model that assumes only the thickness resonance of the casing is excited.

For the 1-D model-based inversion to be valid, the incident pulse has to have a pure angular spectral component propagating at normal incidence to the inside surface of the casing. Typical implementation of borehole ultrasonic cement evaluation tools involves a single mechanically rotated transducer to provide azimuthal coverage. Whereas the angular spectral purity of the acoustic beam can be designed into the apodization of the transducer, tool eccentering is subject to real-world borehole conditions and is difficult to control.

BRIEF DESCRIPTION OF THE DRAWINGS

Embodiments of the disclosure may be better understood by referencing the accompanying drawings.

Figure 1:
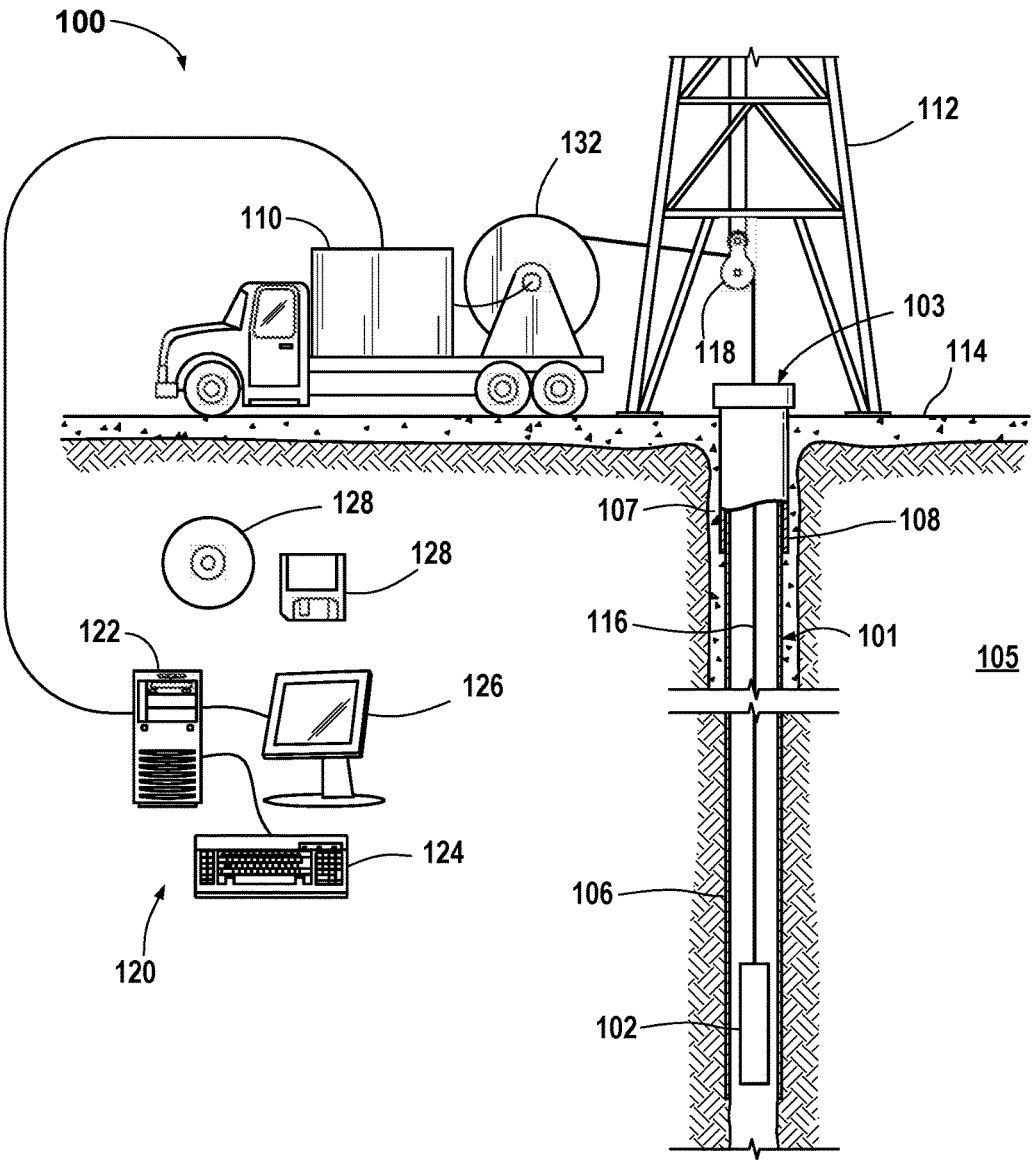
FIG. 1 illustrates a schematic diagram of a cement evaluation system, according to one or more embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown exaggerated in scale or in somewhat schematic form, and some details of conventional elements may not be shown in the interest of clarity and conciseness.

DESCRIPTION

The description that follows includes example systems, methods, techniques, and program flows that embody aspects of the disclosure. However, it is understood that this disclosure may be practiced without certain specific details. For instance, this disclosure refers to well configurations having casing and cement disposed in a wellbore in illustrative examples. Aspects of this disclosure can also be applied to wellbores without casing or cement, i.e., "open hole" wellbores. In other instances, well-known instruction instances, protocols, structures and techniques have not been shown in detail in order not to obfuscate the description.

Introduction

After a wellbore has been cased and lined with cement it is often necessary to evaluate the integrity of the cement, especially a number of years after the cementing has occurred, e.g., in mature wells, as wellbore fluids and/or shifts in geological formation can erode and/or crack the layer of cement which can potentially lead to damage to the integrity of the casing and thus the wellbore. Acoustic tools have been used for cement evaluation but often run into difficulties providing clean results when the tool becomes eccentered in the wellbore. Various mechanical means such as arms or bow springs have been used to maintain the acoustic tool centered in the wellbore, but these can be imprecise and, at times, are not feasible to be deployed. As such, there is a need for an acoustic tool that can provide clean results, e.g., by maintaining spectral purity, while eccentered in the wellbore and/or casing.

Overview

A downhole tool can be deployed having an acoustic transducer array having a plurality of electroacoustic elements disposed circumferentially about the downhole tool, i.e., arrange in a circular shape. The acoustic transducer array can operate by activating active apertures to create synthesized acoustic pulses and receive the pulses' echoes, i.e., acoustic reflections, and then, in cooperation with one or more processors, create a 360° image of the casing and material behind the casing. Based on the image, the cement behind the casing can be evaluated for any defects, e.g., the presence of other materials such as borehole fluid (e.g., drilling mud), formation fluids (e.g., water, gas, hydrocarbons, or the like), or the formation itself. When the acoustic transducer array is eccentered, synthesized acoustic pulses can be adjusted such that the output maintains normal incidence with the casing and accounts for variations in relative standoff.

Example Illustrations

FIG. 1 illustrates a schematic diagram of a cement evaluation system 100, according to one or more embodiments. In one or more embodiments, cement evaluation system 100 can be an acoustic, i.e., sonic, e.g., ultrasonic measurements system. As illustrated, a borehole or wellbore 101 extends from a wellhead 103 into a subterranean formation 105 from surface 114. Generally, the wellbore 101 may include horizontal, vertical, slanted, curved, and other types of wellbore geometries and orientations. The wellbore 101 may be cased, partially cased, i.e., cased to a certain depth (as shown), or uncased. In one or more embodiments, the wellbore 101 may include one or more metallic tubulars, e.g., pipes, disposed therein. By way of example, the one or more metallic tubulars may be one or more casing, liner, well string, completion string, production tubing, or other elongated steel tubular disposed in the wellbore 101. In one or more embodiments, one or more casing may be disposed in the wellbore 101, e.g., a plurality of casing may be disposed in the wellbore, with at least one casing concentrically disposed in another. As shown, a first casing 106 is concentrically disposed in a second casing 108. The second casing 108 can have a larger diameter than the first casing 106. Though not clearly shown in FIG. 1, the first casing 106 can be radially spaced from the second casing 108 such that an annulus is formed therebetween. Note, although two layers of casing are shown, there can be multiple layers of casing, e.g., 3, 4, 5, 6, or 7 layers of casing. Cement 107 can be disposed between the casing and the formation 105, e.g., between the first casing 106 and the formation 105 and/or between the second casing 108 and the formation 105.

As illustrated in FIG. 1, the wellbore 101 may extending generally vertically into the subterranean formation 105; however, the wellbore 101 may extend at an angle (although not shown) through the subterranean formation 105, such as horizontal and slanted wellbores. For example, although FIG. 1 illustrates a vertical or low inclination angle well, high inclination angle or horizontal placement of the well and equipment may be possible. It should further be noted that while FIG. 1 generally depicts a land-based operation, the principles described herein are equally applicable to subsea operations that employ floating or sea-based platforms and rigs, without departing from the scope of the disclosure.

The cement evaluation system 100 can include one or more downhole tools disposed on a conveyance 116, which may be lowered into wellbore 101. For example, a downhole tool 102 is disposed on the conveyance 116. As illustrated, the downhole tool 102 is attached to a vehicle 110 via a drum 132. However, in one or more embodiments, it should be noted that the downhole tool 102 may not be attached to the vehicle 110, e.g., being instead attached to a crane or rig. The conveyance 116 and the downhole tool 102 may be supported by a rig 112 at the surface 114.

The downhole tool 102 may be tethered to the vehicle 110 through the conveyance 116. The conveyance 116 may be disposed around one or more sheave wheels 118 to the vehicle 110. The conveyance 116 may include any suitable means for providing mechanical support and movement for the downhole tool 102, including, but not limited to, wireline, slickline, coiled tubing, pipe, drill pipe, downhole tractor, or the like. In some embodiments, conveyance 116 may provide mechanical suspension as well as electrical connectivity for the downhole tool 102. For example, the conveyance 116 may include, in some instances, one or more electrical conductors extending from the vehicle 110 that may be used for communicating power and/or telemetry between the vehicle 110 and the downhole tool 102.

Information from the downhole tool 102 can be gathered and/or processed by information handling system 120. For example, signals recorded by the downhole tool 102 may be stored on memory and then processed by the information handling system 120. The processing may be performed real-time during data acquisition or after recovery of the downhole tool 102. Processing may occur downhole, at the surface, or may occur both downhole and at surface. In some embodiments, signals recorded by the downhole tool 102 may be conducted to the information handling system 120 by way of the conveyance 116. The information handling system 120 may process the signals and the information contained therein may be displayed, and/or visualized, for an operator to observe and stored for future processing and reference. The information handling system 120 may also contain an apparatus for supplying control signals and power to the downhole tool 102.

Systems and methods of the present disclosure may be implemented, at least in part, with the information handling system 120. The information handling system 120 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, the information handling system 120 may be a personal computer, a network storage device, or any other suitable device and may vary in size, shape, performance, functionality, and price. The information handling system 120 may include random access memory (RAM), one or more processing resources such as a central processing unit (CPU) 122 or hardware or software control logic, ROM, and/or other types of nonvolatile memory. Additional components of the information handling system 120 may include one or more disk drives, one or more network ports for communication with external devices as well as an input device 124 (e.g., keyboard, mouse, etc.) and output devices, such as a display 126. The information handling system 120 may also include one or more buses operable to transmit communications between the various hardware components. Although not shown, the information handling system 120 may include one or more network interfaces. For example, the information handling system 120 can communicate via transmissions to and/or from remote devices via a network interface in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

Alternatively, systems and methods of the present disclosure may be implemented, at least in part, with non-transitory computer-readable, or machine-readable, media 128. Non-transitory computer-readable media 128 may include any instrumentality or aggregation of instrumentalities that may retain data and/or instructions for a period of time. Non-transitory computer-readable media may include, for example, but not limited to, a system, apparatus, or device, that employs any one of or combination of electronic, magnetic, optical, electromagnetic, infrared, or semiconductor technology to store program code. Non-transitory computer-readable media 128 may include, for example, storage media such as a direct access storage device (e.g., a hard disk drive or floppy disk drive), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such wires, optical fibers, microwaves, radio waves, and other electromagnetic (EM) and/or optical carriers; and/or any combination of the foregoing. In the context of this document, a computer-readable storage medium may be any tangible medium that can contain or store a program for use by or in connection with an instruction execution system, apparatus, or device. For example, the computer-readable storage medium can comprise program code executable by a processor to cause the processor to perform one or more steps. The computer-readable storage medium can further comprise program code executable by the process to cause or initiate the one or more downhole tools to perform a function, e.g., transmitting a signal, receiving a signal, and/or taking one or more measurements.

The computer-readable media 128 may be a machine-readable signal medium or a machine-readable storage medium. A computer-readable storage medium is not a machine-readable signal medium. A machine-readable signal medium may include a propagated data signal with machine-readable program code embodied therein, for example, in baseband or as part of a carrier wave. Such a propagated signal may take any of a variety of forms, including, but not limited to, electro-magnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on computer-readable media 128 may be transmitted using any appropriate medium, including but not limited to wireless, wireline, optical fiber cable, radio frequency (RF), etc., or any suitable combination of the foregoing. Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and procedural programming languages, such as the "C" programming language or similar programming languages. The program code may execute entirely on a stand-alone machine, may execute in a distributed manner across multiple machines, and may execute on one machine while providing results and or accepting input on another machine. The program code/instructions may also be stored in a machine-readable medium that can direct a machine to function in a particular manner, such that the instructions stored in the computer-readable storage medium produce an article of manufacture including instructions which implement the function/act specified in the flowchart and/or block diagram block or blocks.

Figure 2:
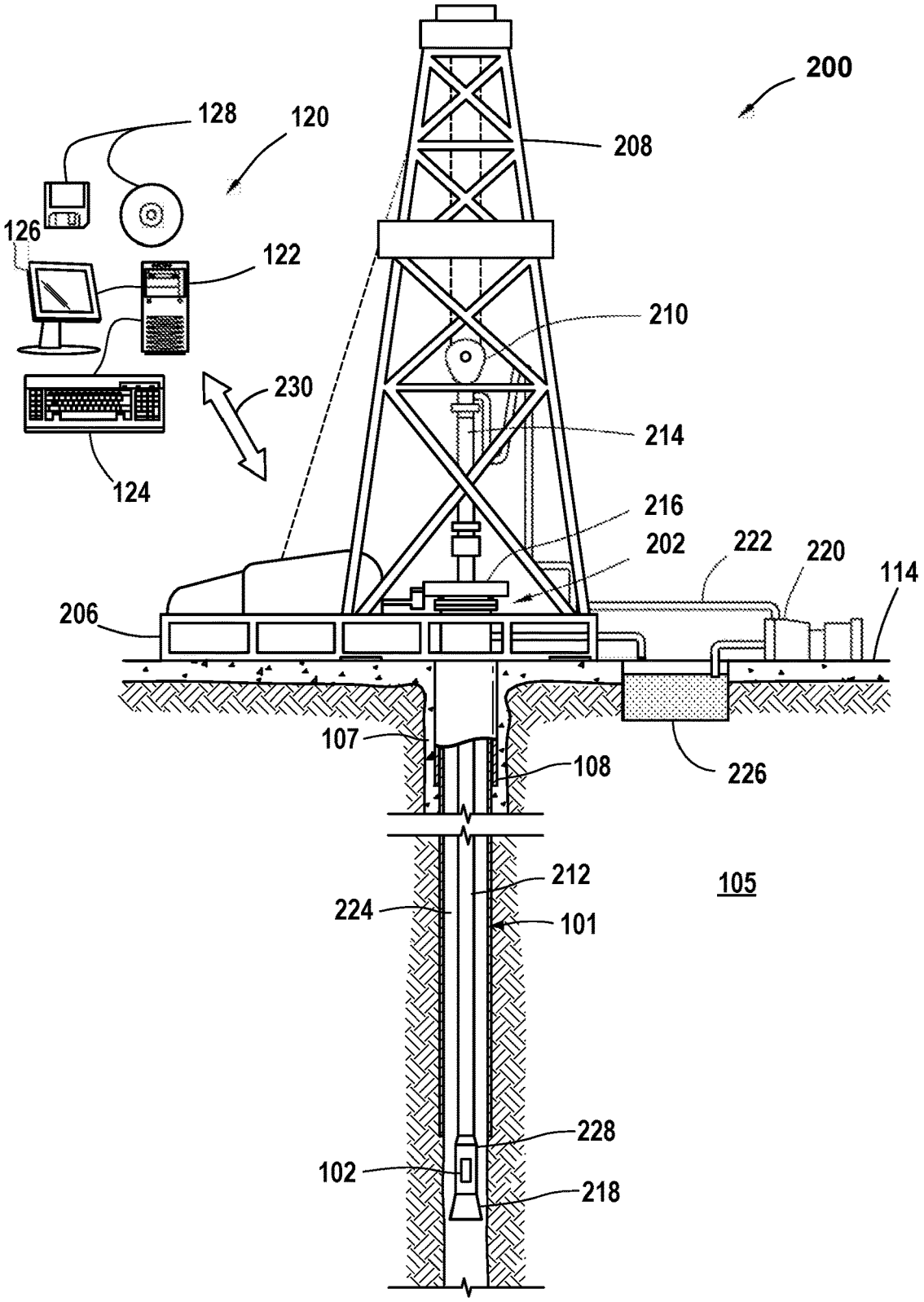
FIG. 2 illustrates a schematic diagram of a drilling system for cement evaluation, according to one or more embodiments.

FIG. 2 illustrates a schematic diagram of a drilling system 200 for cement evaluation, according to one or more embodiments. As illustrated, the downhole tool 102 is disposed in wellbore 101 via the drilling system 200. The drilling system 200 includes a drilling platform 206 that supports a derrick 208 having a traveling block 210 for raising and lowering drill string 212. Drill string 212 may include, but is not limited to, drill pipe and coiled tubing, as generally known to those skilled in the art. A kelly 214 may support the drill string 212 as it may be lowered through a rotary table 216. A drill bit 218 may be attached to the distal end of the drill string 212 and may be driven either by a downhole motor and/or via rotation of drill string 212 from surface 114. Without limitation, the drill bit 218 may include, roller cone bits, PDC bits, natural diamond bits, any hole openers, reamers, coring bits, and the like. As the drill bit 218 rotates, it may create and extend wellbore 101 that penetrates the subterranean formation 105. A pump 220 may circulate drilling fluid through a feed pipe 222 to kelly 214, downhole through interior of drill string 212, through orifices in drill bit 218, back to surface 114 via annulus 224 surrounding drill string 212, and into a retention pit 226.

With continued reference to FIG. 2, drill string 212 may begin at wellhead 202 and may traverse wellbore 101. The drill bit 218 may be attached to a distal end of the drill string 212 and may be driven, for example, either by a downhole motor and/or via rotation of the drill string 212 from surface 114. Drill bit 218 may be a part of bottom hole assembly (BHA) 228 at distal end of drill string 212. In one or more embodiments, the BHA 228 may further include the first downhole tool 102. The downhole tool 102 may be disposed on the outside and/or within the BHA 228. The downhole tool 102 can be used as part of a measurement-while drilling (MWD) or logging-while-drilling (LWD) system.

Without limitation, the downhole tool 102 can be connected to and/or controlled by the information handling system 120. The information handling system 120 may be disposed at the surface 114 or downhole, and thus processing of information recorded may occur downhole and/or on surface 114. Processing occurring downhole may be transmitted to surface 114 to be recorded, observed, and/or further analyzed. Additionally, information recorded on the information handling system 120 that may be disposed downhole may be stored until the downhole tool 102 is brought to surface 114.

In one or more embodiments, the information handling system 120 may communicate with the downhole tool 102 through a communication line (not illustrated) disposed in (or on) drill string 212. In one or more embodiments, wireless communication may be used to transmit information back and forth between the information handling system 120 and at the downhole tool 102. The information handling system 120 may transmit information to the downhole tool 102 and may receive as well as process information recorded by the downhole tool 102. In one or more embodiments, a downhole information handling system (not illustrated) may include, without limitation, a microprocessor or other suitable circuitry, for estimating, receiving and processing signals from the downhole tool 102. Downhole information handling system (not illustrated) may further include additional components, such as memory, input/output devices, interfaces, and the like. In one or more embodiments, while not illustrated, the downhole tool 102 may include one or more additional components, such as analog-to-digital converter, filter and amplifier, among others, that may be used to process the measurements of downhole tool 102 before the measurements can be/have been transmitted to the surface 114. Alternatively, raw measurements from the downhole tool 102 may be transmitted to surface 114.

Any suitable technique may be used for transmitting signals from the downhole tool 102 to the surface 114, including, but not limited to, wired pipe telemetry, mud-pulse telemetry, acoustic telemetry, and EM telemetry. While not illustrated, the downhole tool 102 may include a telemetry subassembly that may transmit telemetry data to the surface 114. Without limitation, an EM source in the telemetry subassembly may be operable to generate pressure pulses in the drilling fluid that propagate along the fluid stream to the surface 114. At the surface 114, pressure transducers (not shown) may convert the pressure signal into electrical signals for a digitizer (not illustrated). The digitizer may supply a digital form of the telemetry signals to the information handling system 120 via a communication link 230, which may be a wired or wireless link. The telemetry data may be analyzed and processed by the information handling system 120. In addition to, or in place of, processing at the surface 114, processing may occur downhole.

In one or more embodiments, the downhole tool 102 may operate with additional equipment (not illustrated) on the surface 114 and/or disposed in a separate well measurement system (not illustrated) to record measurements and/or values from the subterranean formation 105.

Figure 3B:
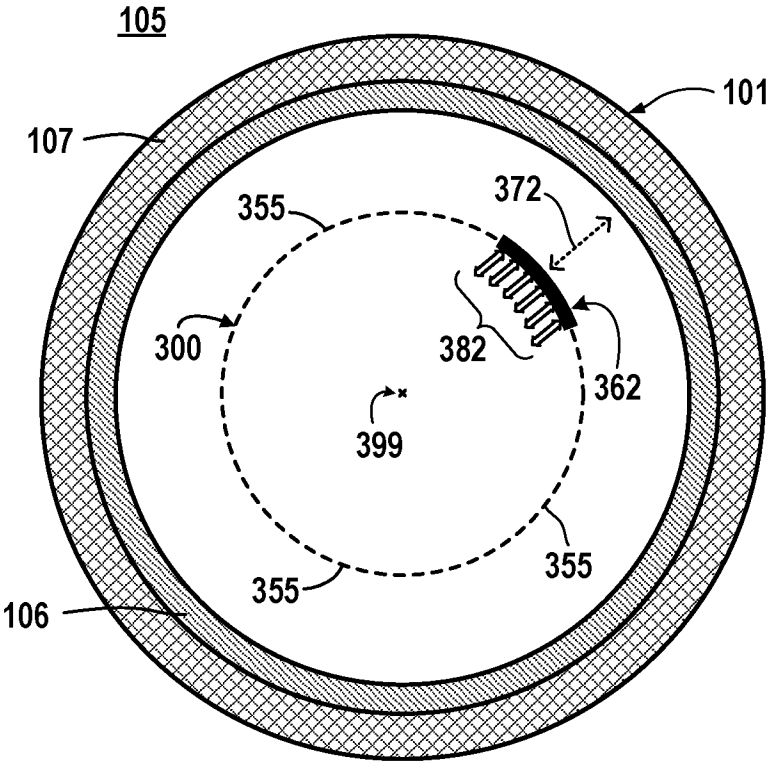
FIG. 3B depicts a cross-sectional diagram of the acoustic transducers array centered in wellbore and active in a second direction, according to one or more embodiments.
Figure 3A:
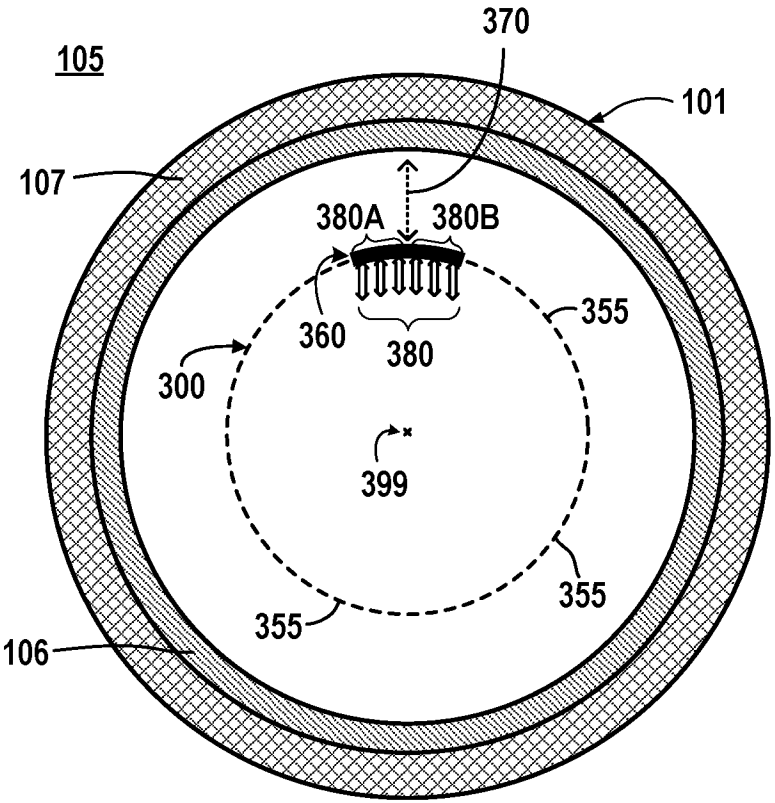
FIG. 3A depicts a cross-sectional diagram of an acoustic transducers array centered in wellbore and active in a first direction, according to one or more embodiments.

FIG. 3A depicts a cross-sectional diagram of an acoustic transducers array 300 centered in wellbore 101 and active in a first direction, according to one or more embodiments. The wellbore 101 is depicted as lined with casing 106, i.e., having a casing disposed therein, and having a material, e.g., cement 107 as shown, disposed between the formation 105 and the casing 106. Although not depicted, the acoustic transducers array 300 is disposed on or housed by the downhole tool 102. For example, the acoustic transducer array can be disposed about a mandrel or a tool body.

As depicted, the acoustic transducers array 300 is circular and centered within the casing 106, i.e., centered at a casing center 399. The casing center 399 is the geometric center of the casing in the radial plane (assuming the casing is completely round). The acoustic transducers array 300 has a plurality of transducers or electroacoustic elements 355 arranged in a circle (i.e., circumferentially), e.g., arranged circumferentially about an outer surface or mandrel of the downhole tool or mandrel 102. In one or more embodiments, each electroacoustic element 355 is independent of the other electroacoustic elements. For example, each electroacoustic element 355 can be acoustically and electrically isolated from its neighboring electroacoustic elements. In one or more embodiments, isolation is accomplished via an isolation trench in a backing material to the electroacoustic elements 355.

The electroacoustic elements 355 can be acoustic transducer elements and can include piezoelectric elements, electrostatic elements, electro-magnetic-transducer (EMAT) elements, or any other element that can convert electrical signals into acoustic energy and vice versa. Although not shown here, each electroacoustic element 355 can be coupled, e.g., via an element backing, to one or more sensor electronics. In one or more embodiments, the one or more sensor electronics can include transmit (TX) electronics and receive (RX) electronics.

In one or more embodiments, the centers of each electroacoustic element 355 of the plurality of electroacoustic elements are spaced at least a half wavelength apart from each other. For example, the centers can be at least 1.5 mm apart. Spacing can be widened to increase isolation of each electroacoustic element 355 and/or reduce the number of electroacoustic elements 355 used.

The acoustic transducers array 300 can be two-dimensional (2D) or three-dimensional (3D) circular arrays. For the sake of understanding the disclosure, the functioning of the acoustic transducers array 300 is only described in two dimensions, i.e., in a radial oriented plane. However, in one or more embodiments, the acoustic transducers array 300 extends axially, e.g., in a grid pattern or multiple rings of circular 2D arrays. Such a 3D acoustic transducer array can apply similar techniques as described herein to provide less sensitivity to axial misalignment.

A full array in 2D can have more than 50, more than 60, more than 100, more than 120, more than 150, or more than 200 electroacoustic elements 355. In one or more embodiments, there are an even or odd number of electroacoustic elements 355. In one or more embodiments, there are an even number of electroacoustic is a binary based. For example, the acoustic transducers array 300 can have 32, 64, 128, or 256 electroacoustic elements 355.

The acoustic transducer array 300 operates by activating active apertures to create synthesized acoustic pulses, receiving the pulses' echoes, i.e., acoustic reflections, and then, in cooperation with one or more processors, creating a 360° image of the casing and material behind the casing. Based on the image, cement—the desired material behind the casing in a cemented well—can be evaluated for any defects, e.g., the presence of other materials such as borehole fluid (e.g., drilling mud), formation fluids (e.g., water, gas, hydrocarbons, or the like), or the formation itself. This azimuthal scanning of the casing and material behind the casing is conducted electronically by sequencing active apertures, e.g., without a motor or rotating seal involve. In one or more embodiments, the synthesized acoustic pulses have a frequency below 1 megahertz (MHz).

Each active aperture is made up of sets of electroacoustic elements 355. The sets can define the circumferential extent of each active aperture. Each set can have electroacoustic elements 355 that are mutually exclusive from those in other sets or the sets can share one or more electroacoustic elements 355. In one or more embodiments, an active aperture is composed of M contiguous elements that are operated together as a group, where M is a suitable number of elements such that a transmit beam, e.g., an acoustic pulse, with a required angular spectral purity is achieved through phasing/time-delay and amplitude weighting of constituent elements of the active aperture. A plane wave is considered to have angular spectral purity when energy is going in one direction. M is illustrated to be 6 in the FIG. 3A, but could be 7, 8, 9 as desired.

In one or more embodiments, each active aperture excites the synthesized acoustic pulse at a different time from the other sets. For example, the active apertures can produce and receive pulses sequentially starting from a first set until all the sets have excited a pulse and receive an acoustic reflection thus creating a pulse/echo around the entire circumference of the acoustic transducer array 300 that can be processed to form the 360° image. In one or more embodiments, the active apertures can correspond to azimuthal bins or angles around the circumference of the downhole tool.

In one example mode of operation, the two apertures can also be activated simultaneously. Thus, two measurements in two different directions can be obtained at the same time. Such simultaneous operation can be conducted as long as the acoustics of the active apertures do not interfere with each other. In general, simultaneous operation of N>=2 non-interfering apertures can be executed. The benefit of such mode of operation is that, at a specific measurement depth, a full 360° coverage of the wellbore 101 can be accomplished at 1/N of the time required when only a single active aperture is operated at a time, and the resulting axial logging speed is increased N-fold. In one or more embodiments, multiple sets (e.g., 2 sets, 3 sets, 4 sets, 6 sets, or 8 sets) whose centers are separated by azimuthal angle of 40° or more can be excited to output a pulse at a first time followed by an adjacent set (e.g., the neighboring set to the right or to the left—but always the same direction) being excited at a second time. The received acoustic reflections at each set can be formed into the 360° image.

As depicted in FIG. 3A, a first active aperture 360 is chosen, wherein the first active aperture 360 includes a first set 380 of the plurality of electroacoustic elements 355. In one or more embodiments, the first set 380 has a first subset 380A and second subset 380B forming two halves of the first set 380, i.e., the first subset 380A includes half of the electroacoustic elements 355 located on a first side of a first midpoint of the first active aperture 360 and the second subset 380B includes half of the electroacoustic elements 355 located on a second side of the first midpoint.

A first radius running from the casing center 399 to an inner diameter of the casing 106 is determined based on azimuthal angle of the first active aperture 360, wherein the azimuthal angle of the first active aperture 360 is based on an azimuthal direction of the two centermost electroacoustic elements 355 of the of the first set 380. The first midpoint is defined at a first point where the first radius intersects the circumference of the acoustic transducer array 300 between the two centermost electroacoustic elements 355 of the of the first set 380. A radius from the casing center 399 is always perpendicular, i.e., normal, to an inner surface of the casing 106.

Once the first midpoint is determined, a first relative standoff can be determined or estimated at the first midpoint. As the acoustic transducers array 300 is centered in the casing 106, the relative standoff is constant. In one or more embodiments, the geometry, i.e., geometric dimensions such as circumference and diameter, of the downhole tool 102 and the acoustic transducers array 300 array are known. Further, information about the casing., i.e., casing data, can be determined or known for each wellbore 101. Beam-forming parameters can be set up according to the casing data, taking an assumption that the acoustic transducers array 300 is perfectly centered with respect to the casing (as depicted in FIG. 3A). For example, first beam-forming parameters can be determined for the first active aperture 360 based on the casing data and geometry of the downhole tool 102 and the acoustic transducers array 300. The beam-forming parameters can include adjustments to transmit and/or receive waveforms and can include amplitude weighting, phase delay, and/or time delay. The beam-forming parameters can also take into account the relative standoff, especially when the acoustic transducers array 300 (as in FIGS. 4A-4B) is eccentered. For example, the first beam-forming parameters can be based on, i.e., take account for, the first relative standoff.

Based on the first beam-forming parameters, the first set 380 of electroacoustic elements is excited to output a first synthesized acoustic pulse. The first synthesized acoustic pulse can be formed by applying the first beam-forming parameters to the transmit waveforms of each electroacoustic element 355 in the first set 380. As the acoustic transducers array 300 is centered in this example, the first synthesized acoustic pulse, i.e., a first transmission beam, is launched radially outward with respect to the center of the acoustic transducers array 300 (which for a centered tool shares the same point as the casing center 399).

Then the first set 380, with the electroacoustic elements in receive mode, receives a first acoustic reflection, i.e., a first reflection waveform. The first reflection waveform from the casing 106 is received and processed with first beam-forming parameters applied to the first transmission beam. Based on the first acoustic reflection, a first azimuthal portion of the 360° image of the casing 106 and material behind the casing 106, e.g., cement 107 or other materials instead of cement, is determined. Further, based on the first acoustic reflection, an acoustic impedance of the material behind the casing (e.g., cement or not cement) can be determined. For example, a first acoustic impedance can be determined based on the first acoustic reflection. The first acoustic impedance can be determined by performing a 1D inversion based on the first acoustic reflection. The first acoustic impedance can be used to form the first azimuthal portion of the 360° image of the casing 106 and material behind the casing 106.

FIG. 3B depicts a cross-sectional diagram of the acoustic transducers array 300 centered in wellbore 101 and active in a second direction, according to one or more embodiments. In further operation of the acoustic transducer array 300, a second active aperture 362 can be chosen. The second active aperture 362 can be oriented in the second direction, i.e., at a different azimuthal angle from the first active aperture 360. The second active aperture 362 includes a second set 382 of electroacoustic element 355. The second set 382 can include at least one different electroacoustic element 355 from the first set 380, e.g., if the first active aperture 360 partially overlaps the second active aperture 362. In one or more embodiments, the second set 382 include none of the same electroacoustic elements 355 as the first set. For example, the second set 382 can be adjacent, i.e., neighboring, circumferentially to the first set 380. Further sets can be chosen such that all 360 degrees of the acoustic transducer array 300 is activated at different times to provide the 360° image of the casing 106 and material behind the casing 106.

Once the second active aperture 362 is chosen, a second radius running from the casing center 399 to an inner diameter of the casing 106 is determined based on azimuthal angle of the second active aperture 362, wherein the azimuthal angle of the second active aperture 362 is based on an azimuthal direction of the two centermost electroacoustic elements 355 of the of the second set 382. A second midpoint is defined at a first point where the second radius intersects the circumference of the acoustic transducer array 300 between the two centermost electroacoustic elements 355 of the of the second set 382.

Once the second midpoint is determined, a second relative standoff can be determined or estimated at the second midpoint. As the acoustic transducers array 300 is centered in the casing 106, the relative standoff is constant. As mentioned above, the geometry of the downhole tool 102 and the acoustic transducers array 300 array are known, and casing data can be determined or known for the casing 106. Second beam-forming parameters can be determined for the second active aperture 362 based on the casing data and the geometry of the downhole tool 102 and the acoustic transducers array 300. The second beam-forming parameters can include adjustments to transmit and/or receive waveforms and can include amplitude weighting, phase delay, and/or time delay. The second beam-forming parameters can be based on, i.e., take account for, the second relative standoff.

Based on the second beam-forming parameters, the second set 382 of electroacoustic elements is excited to output a second synthesized acoustic pulse. The second synthesized acoustic pulse can be formed by applying the second beam-forming parameters to the transmit waveforms of each electroacoustic element 355 in the second set 382. As the acoustic transducers array 300 is centered in this example, the second synthesized acoustic pulse, i.e., a second transmission beam, is launched radially outward with respect to the center of the acoustic transducers array 300 (which for a centered tool shares the same point as the casing center 399).

Then the second set 382, with the electroacoustic elements in receive mode, receives a second acoustic reflection, i.e., a second reflection waveform. The second reflection waveform from the casing 106 is received and processed with second beam-forming parameters that were applied to the second transmission beam. Based on the second acoustic reflection, a second azimuthal portion of the 360° image of the casing 106 and material behind the casing 106, e.g., cement 107 or other materials instead of cement, is determined. Further, based on the second acoustic reflection, a second acoustic impedance of the material behind the casing (e.g., cement or not cement) can be determined. The second acoustic impedance can be determined by performing a 1D inversion based on the second acoustic reflection. The second acoustic impedance can be used to form the second azimuthal portion of the 360° image of the casing 106 and material behind the casing 106.

The first active aperture 360 outputs the first synthesized pulse at a first normal incidence 370 and the second active aperture 362 outputs the second synthesized pulse at a second normal incidence 372. Propagation of the pulses at normal incidence in combination with spectral purity of the pulse can simplify inversion, e.g., 1D inversion.

As with the second active aperture 362, the beam-formed transmit and receive operation is repeated by shifting the active aperture circularly/successively until a full 360° coverage of the casing 106 (and material behind the casing) is accomplished.

In FIG. 3A and FIG. 3B, the casing center corresponds to the center of the acoustic transducer array as the acoustic transducer array 300 is shown centered in the wellbore 101, and particular centered in the casing. An initial 360° scan with the active apertures can be performed by exciting each electroacoustic element (or a subset thereof equally space about the acoustic transducer array) to apply a pulse to each at a first time to determine the standoff of each electroacoustic element 355 from the casing based on return delay time, i.e., transit time, of the acoustic reflection, i.e., the measured/received echo waveforms. Based on the return time delay at each of the electroacoustic elements 355 used in the initial scan standoff distances can be determined or estimated from each of the electroacoustic elements 355 used in the initial scan. If all the standoff distances are equal or approximately equal (as determined by a desired threshold), the acoustic transducer array 300 can be determined to be centered. If the standoff distances are not all equal, then either the casing is not round (e.g., it has ovality or warping at the measured plane) or the acoustic transducer array 300 is eccentered (e.g., due to the downhole tool 102 being eccentered). If no eccentering is detected, the beam-forming parameters for the next 360° scan remain the same. If eccentering is present, the active apertures and the corresponding beam-forming parameters are adapted according to the prescription described in FIGS. 4A-4B. As such, the beam-forming set up for the current 360-degree scan is based on the tool eccentering estimation from the previous 360° results. Adaptive beam-forming can also correct for errors in the casing data.

Without a method to account for it, tool eccentering can result in off-normal incidence of the output acoustic beam which can lead to generation of unwanted modes in the casing that are not accounted for in 1-D model inversion and can thus give rise to significant error in the determination of acoustic impedance behind the casing 106.

Figure 4B:
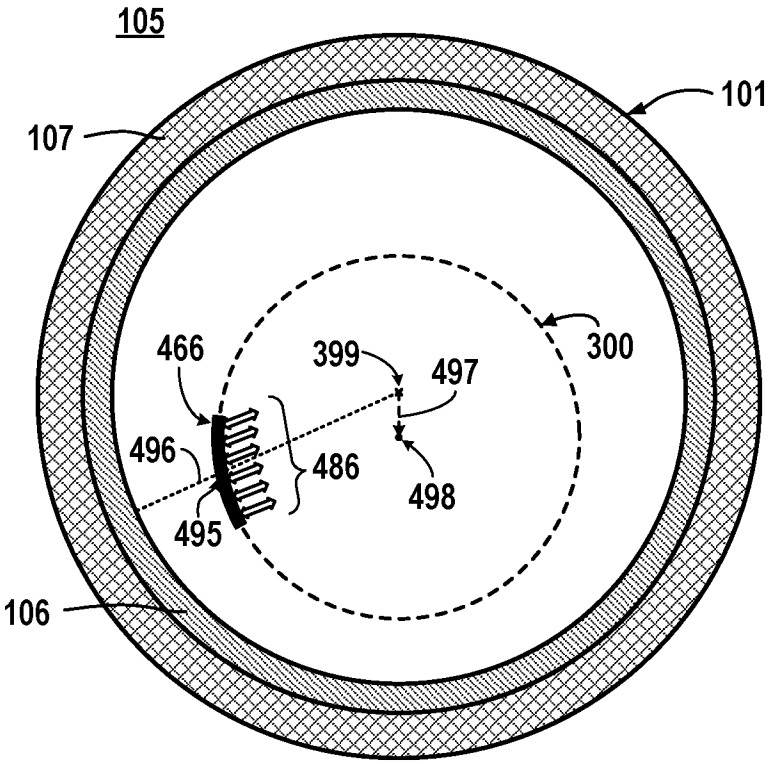
FIG. 4B depicts a cross-sectional diagram of the acoustic transducers array eccentered in wellbore and active in a fourth direction, according to one or more embodiments.
Figure 4A:
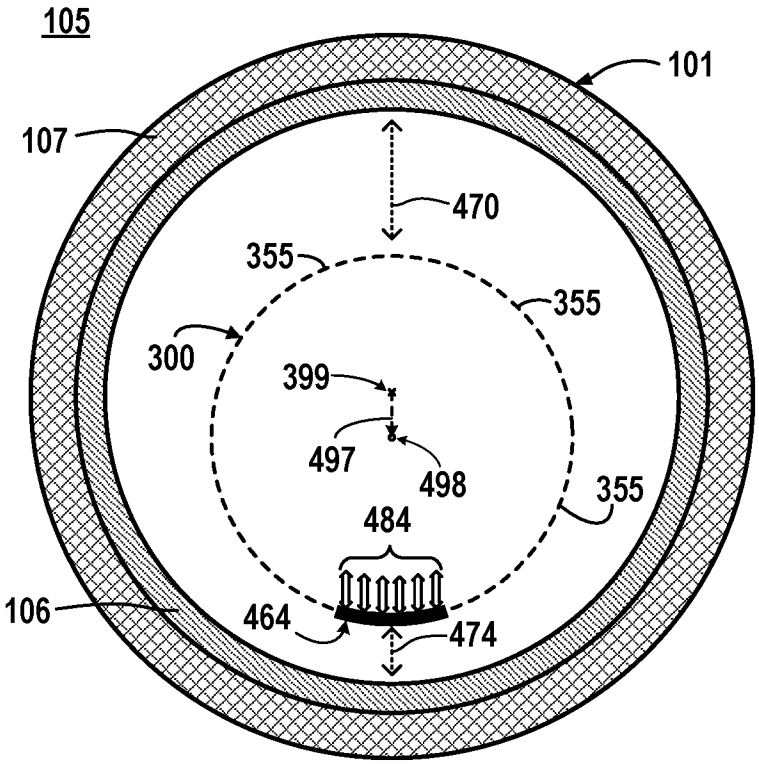
FIG. 4A depicts a cross-sectional diagram of the acoustic transducers array eccentered in wellbore and active in a third direction, according to one or more embodiments.

FIG. 4A depicts a cross-sectional diagram of the acoustic transducers array 300 eccentered in wellbore 101 and active in a third direction, according to one or more embodiments. The magnitude and direction of the eccentricity, i.e., the distance and angle off from the casing center, is represented by an eccentering vector 497. The eccentering vector 497 extends from the casing center 399 to an array center 498 with direction of the eccentering vector 497 towards the array center 498, where the array center 498 is the geometric center of the circular shaped acoustic transducers array 300. The array center 498 can be known based on design of the acoustic transducer array 300.

The eccentering vector 497 can be determined based on a casing radius magnitude and the standoff distances acquired in the initial scan. The casing radius magnitude, i.e., the distance from the casing center to the inner wall of the casing 106, can be determined based on the standoff distances acquired in the initial scan. Further, the casing center 399 can be determined, e.g., estimated or calculated, using the casing radius magnitude and the eccentering vector. The casing center 399 can be the center of the casing 106 at a radial oriented plane of the acoustic transducer array 300.

When the acoustic transducer array 300 is eccentered, normal incidence is lost for the majority of the acoustic transducers array 300 if the acoustic transducer array 300 is operated as if the acoustic transducer array 300 is centered (i.e., without applying the method described herein). For example, only two azimuthal angles in the eccentered acoustic transducers array 300 can provide normal incidence, represented by a first arrow 470 and second arrow 474 in FIG. 4A. In general, the two azimuthal angles that provide normal incidence will track the direction and anti-direction of the eccentering vector 497. Away from the two azimuthal angles the incidence angle deviate from normal, i.e., the reflections from an initial pulse travel at a different angle from the output pulse due to the curvature of the casing 106. The largest deviations from normal can occur at 90 degrees from the two azimuthal angles, i.e., 90 degrees from the angle of the eccentering vector 497. When the propagation of a pulse-echo waveform is deviated from normal, the reflected acoustic waveform can steer away from the active transducer, thus weaking the received signal potentially leading to signal-to-noise problems in the inversion processing.

In operation while eccentered, a third active aperture 464 of the acoustic transducer array 300 is chosen, where the third active aperture 464 includes a third set 484 of the plurality of electroacoustic elements 355. Once the third active aperture 464 is chosen, a third radius running from the casing center 399 to an inner diameter of the casing 106 is determined based on azimuthal angle of the third active aperture 464, wherein the azimuthal angle of the third active aperture 464 is based on an azimuthal direction of the two centermost electroacoustic elements 355 of the of the third set 484. A third midpoint is defined at a point where the third radius intersects the circumference of the acoustic transducer array 300 between the two centermost electroacoustic elements 355 of the of the third set 484.

Once the third midpoint is determined, a third relative standoff can be determined or estimated at the third midpoint. The third relative standoff can be determined from the standoff distances calculated in the initial scan (described above) for each of the electroacoustic elements 355 in the third set 484. As mentioned above, the geometry of the downhole tool 102 and the acoustic transducers array 300 array are known, and casing data can be determined or known for the casing 106. Third beam-forming parameters can be determined for the third active aperture 464 based on the third relative standoff, the casing data, and the geometry of the downhole tool 102 and the acoustic transducers array 300. The third beam-forming parameters can include adjustments to transmit and/or receive waveforms and can include amplitude weighting, phase delay, and/or time delay.

Based on the third beam-forming parameters, the third set 484 of electroacoustic elements is excited to output a third synthesized acoustic pulse. The third synthesized acoustic pulse can be formed by applying the third beam-forming parameters to the transmit waveforms of each electroacoustic element 355 in the third set 484. As the acoustic transducers array 300 is eccentered in this example, the third synthesized acoustic pulse, i.e., a third transmission beam, is launched in a direction the casing wall along the line of the third radius (not shown) spanning from the casing center 399 through the third midpoint.

Then the third set 484, with its electroacoustic elements in receive mode, receives a third acoustic reflection, i.e., a third reflection waveform. The third reflection waveform from the casing 106 is received and processed with third beam-forming parameters that were applied to the third transmission beam. Based on the third acoustic reflection, a third azimuthal portion of the 360° image of the casing 106 and material behind the casing 106, e.g., cement 107 or other materials instead of cement, is determined. Further, based on the third acoustic reflection, a third acoustic impedance of the material behind the casing (e.g., cement or not cement) can be determined. The third acoustic impedance can be determined by performing a 1D inversion based on the third acoustic reflection. The third acoustic impedance can be used to form the third azimuthal portion of the 360° image of the casing 106 and material behind the casing 106.

Because the azimuthal direction of the third active aperture 464 is in the direction of one of the two normal incidence in spite of the eccentricity of the acoustic transducers array 300, spectral purity is not affected by off-normal incidence. However, the relative standoff distance is shortened compared to the centered cases in FIGS. 3A-3B, as such the third beam-forming parameters can be appropriately adjusted to account for the shortened relative standoff.

FIG. 4B depicts a cross-sectional diagram of the acoustic transducers array 300 eccentered in wellbore 101 and active in a fourth direction, according to one or more embodiments. In FIG. 4B the acoustic transducers array 300 is eccentered by the same distance and in the same direction as in FIG. 4A. As such, the eccentering vector 497 and casing center 399 determined above can be utilized.

In FIG. 4B, a fourth active aperture 466 of the acoustic transducer array 300 is chosen, where the fourth active aperture 466 includes a fourth set 486 of the plurality of electroacoustic elements 355. Once the fourth active aperture 466 is chosen, a fourth radius running from the casing center 399 to an inner diameter of the casing 106 is determined based on azimuthal angle of the fourth active aperture 466, wherein the azimuthal angle of the fourth active aperture 466 is based on an azimuthal direction of the two centermost electroacoustic elements 355 of the of the fourth set 486. A fourth midpoint 495 is defined at a point where the fourth radius intersects the circumference of the acoustic transducer array 300 between the two centermost electroacoustic elements 355 of the of the fourth set 486.

Because of the azimuthal angle of the fourth active aperture 466 and the eccentricity, the angle of the fourth radius is different from an angle of a line measured from the array center 498 to the fourth midpoint 495. The angle of the fourth radius can determine a desired effective output direction to assure normal incidence and thereby an accurate echo, i.e. reflection.

Once the fourth midpoint 495 is determined, a fourth relative standoff can be determined or estimated at the fourth midpoint 495. The fourth relative standoff can be determined from the standoff distances calculated in the initial scan (described above) for each of the electroacoustic elements 355 in the fourth set 486. A normal incidence from the fourth midpoint 495 can be determined based on the location of the fourth midpoint 495 and the casing center 399 (e.g., by finding the fourth radius through the midpoint to the inner diameter of the casing as described above). As mentioned above, the geometry of the downhole tool 102 and the acoustic transducers array 300 array are known, and casing data can be determined or known for the casing 106. Fourth beam-forming parameters can be determined for the fourth active aperture 466 based on the fourth relative standoff, the casing data, and the geometry of the downhole tool 102 and the acoustic transducers array 300. The fourth beam-forming parameters can include adjustments to transmit and/or receive waveforms and can include amplitude weighting, phase delay, and/or time delay.

Based on the fourth beam-forming parameters, the fourth set 486 of electroacoustic elements is excited to output a fourth synthesized acoustic pulse. The fourth synthesized acoustic pulse can be formed by applying the fourth beam-forming parameters to the transmit waveforms of each electroacoustic element 355 in the fourth set 486. As the acoustic transducers array 300 is eccentered in this example, the fourth synthesized acoustic pulse, i.e., a fourth transmission beam, is launched in a direction the casing wall along the line of the fourth radius 496 spanning from the casing center 399 through the fourth midpoint 495.

Then the fourth set 486, with its electroacoustic elements in receive mode, receives a fourth acoustic reflection, i.e., a fourth reflection waveform. The fourth reflection waveform from the casing 106 is received and processed with fourth beam-forming parameters that were applied to the fourth transmission beam. Based on the fourth acoustic reflection, a fourth azimuthal portion of the 360° image of the casing 106 and material behind the casing 106, e.g., cement 107 or other materials instead of cement, is determined. Further, based on the fourth acoustic reflection, a fourth acoustic impedance of the material behind the casing (e.g., cement or not cement) can be determined. The fourth acoustic impedance can be determined by performing a 1D inversion based on the fourth acoustic reflection. The fourth acoustic impedance can be used to form the fourth azimuthal portion of the 360° image of the casing 106 and material behind the casing 106.

In one or more embodiments, including those described above, the synthesized acoustic pulses (e.g., the first synthesized acoustic pulse, the second synthesized acoustic pulse, the third synthesized acoustic pulse, and/or the fourth synthesized acoustic pulse) are formed by applying the beam-forming parameters thereto to adjust at least one of amplitude, time delay, and phase of an acoustic output of each electroacoustic element in a set of the active aperture based on the normal incidence, and by beamforming the adjusted acoustic output of each electroacoustic element in the set.

In one or more embodiments, similar beamforming and adjustment occurs during receiving of the acoustic reflection. Receiving the first acoustic reflection via the same transmit set can include receiving an acoustic reflection at each of the electroacoustic elements in the set, wherein the acoustic reflection is based on interaction of the synthesized acoustic pulse with at least one of the casing and the material behind the casing. Then, the same beam-forming parameters applied to the synthesized acoustic pulse and be applied to the received acoustic reflection to adjust at least one of amplitude, time delay, and phase of the received acoustic reflection for each of the electroacoustic elements in the set, where the adjustment to the acoustic reflection at each of the electroacoustic elements in the set matches the adjustment of the acoustic output each particular electroacoustic element in the particular set.

While not discussed in detail herein, the adaptive beam-forming technique to create the synthesized acoustic pulses with the active aperture can be applied to accommodate casings that are slightly out of round, i.e., having ovality. By using the standoff distances in the initial scan, a profile of the inner surface of the casing can be determined, i.e., calculated or estimated, and surface normals can be determined therefrom. The synthesized acoustic pulses can be adjusted in the manner describe above to assure the output pulses maintain normal incidence at active aperture.

One or more of the method steps as described throughout this disclosure can be implemented by program code. The program code may be provided to a processor of a general-purpose computer, special purpose computer, or other programmable machine or apparatus.

As will be appreciated, aspects of the disclosure may be embodied as a system, method or program code or instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Figure 5:
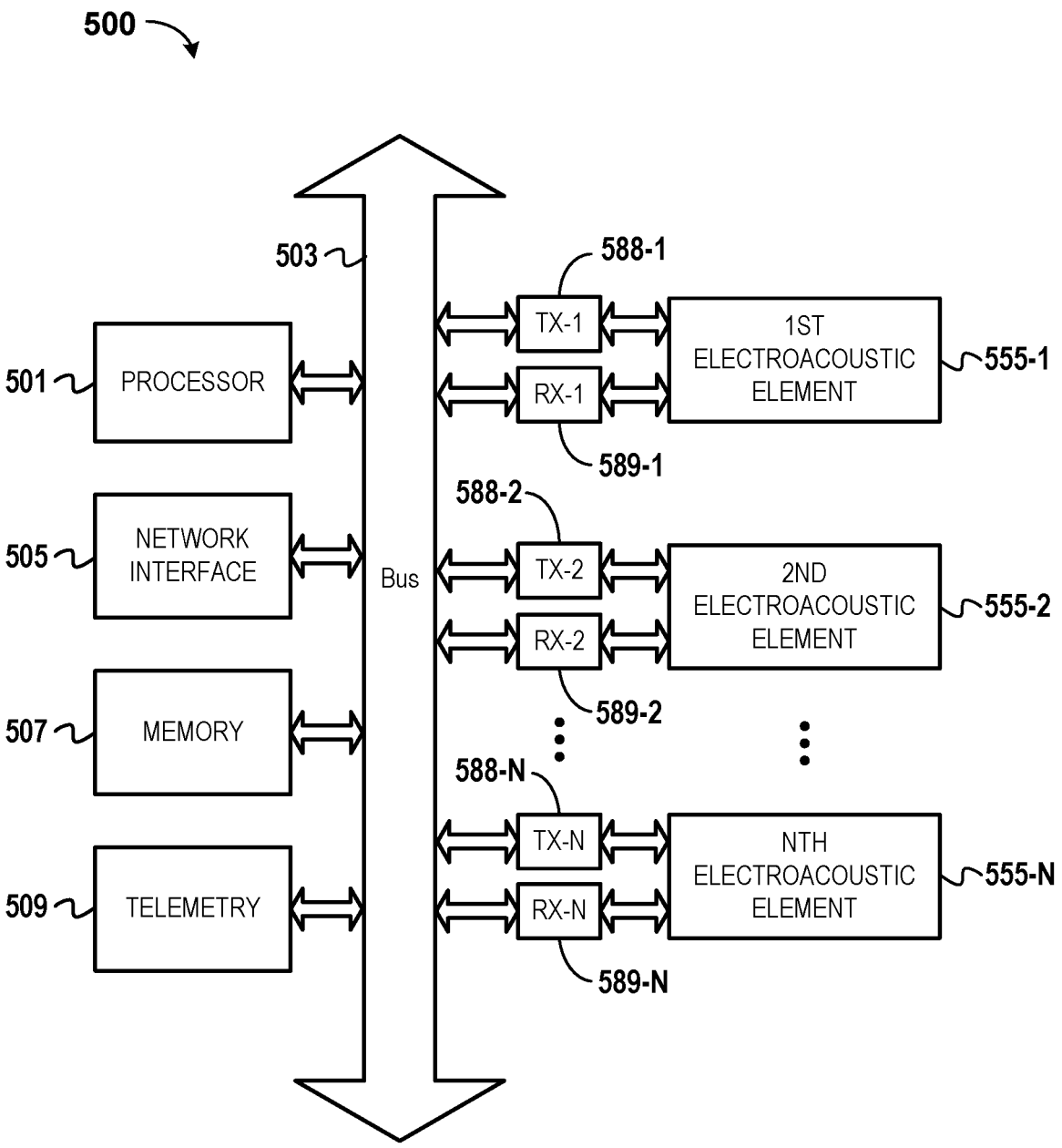
FIG. 5 depicts an example electronics system for the acoustic transducer array, according to one or more embodiments.

FIG. 5 depicts an example electronics system 500 for the acoustic transducer array 300, according to one or more embodiments. The computer system includes a processor 501 (possibly including multiple processors, multiple cores, multiple nodes, and/or implementing multi-threading, etc.). The computer system includes memory 507. The memory 507 may be system memory or any one or more of the above already described possible realizations of machine-readable media. The computer system also includes a bus 503, a network interface 505, and a telemetry module 509. The telemetry module 509 can be programmed with code and/or contain logic for transmission of data to the surface or to remote locations, e.g., via encoding and or modulation. The system also includes N electroacoustic elements 555-1, 555-2, . . . 555-N (each corresponding to the individual electroacoustic elements 355 above). Each of the electroacoustic elements 555-1, 555-2, . . . 555-N are coupled to sensor electronics, e.g., transmitter (TX) electronics and receiver (RX) electronics. Transmitter electronics can include one or more amplifiers, a digital to analog converter (DAC), and other electronic components for exciting the electroacoustic element to produce an acoustic output signal (i.e., a pulse), and optionally effectuating adjustment of the acoustic output signal related to outputting the synthesized acoustic pulse, as described above. Receiver electronics can include one or more amplifier (e.g., one or more low noise amplifier (LNA), one or more variable gain amplifier (VGA), or the like), one or more analog to digital converter (ADC).

As depicted, first TX electronics 588-1 and first RX electronics 589-1 are coupled to the $1^{st}$ electroacoustic element 555-1 and second TX electronics 588-2 and second RX electronics 589-2 are coupled to the $2^{nd}$ electroacoustic element 555-2. As indicated by the ellipses, all the following electroacoustic elements in the acoustic transducer array are likewise coupled to both a TX electronics and RX electronics, wherein the Nth TX electronics 588-N and the Nth RX electronics 589-N are coupled to the Nth electroacoustic element 555-N.

In one or more embodiments, there are less sensor electronics than the number of electroacoustic elements. For example, a single TX electronics and/or a single RX electronics can be coupled to more than one electroacoustic element, e.g., electroacoustic elements of different sets, such that the same sensor electronics control multiple electroacoustic elements. This can reduce the amount of downhole electronics required, thereby reducing size, cost, and/or complexity of the downhole tool. In one or more embodiments, the number of sensor electronics corresponds to the number of electroacoustic elements that make up each set for active aperture. In this example, a set may comprise M electroacoustic elements, e.g., a $1^{st}$ electroacoustic element, a $2^{nd}$ electroacoustic element, to a Mth electroacoustic element and there are M sensor electronics. In this arrangement, first sensor electronics (TX and/or RX) are coupled to the $1^{st}$ electroacoustic element of each set, second sensor electronics (TX and/or RX) are coupled to the 2nd electroacoustic element of each set, and so forth to the Mth sensor electronics and Mth electroacoustic element for each set. This is feasible, for example, when for sets that are not activated at the same time. Other combinations and permutations of a ratio of numbers of sensor electronics to number of electroacoustic elements are possible.

Any one of the previously described functionalities may be partially (or entirely) implemented in hardware and/or on the processor 501. For example, the functionality may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). The processor 501, the network interface 505, and telemetry 509 are coupled to the bus 503. Although illustrated as being coupled to the bus 503, the memory 507 may be coupled to the processor 501. Note, while the processor 501 is depicted as a single item, it should be understood to include multiple processors, including processing occurring in the downhole tool 102, elsewhere in the tool string (e.g. a BHA), at the surface, or at a remote facility. Processing via the processor 501 also can include post-processing of data taken downhole and stored for at least some time in memory.

Figure 6:
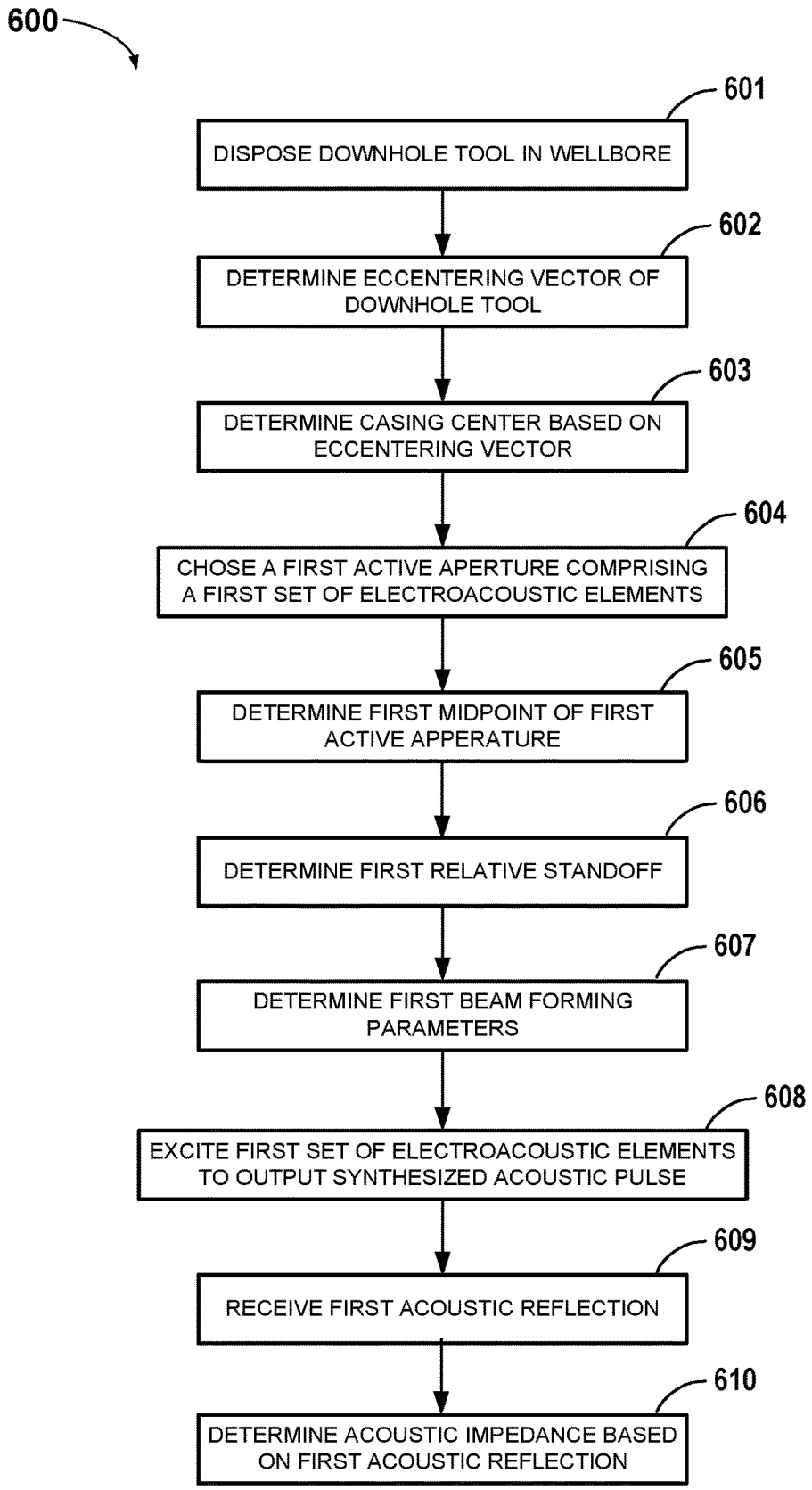
FIG. 6 illustrates a flowchart depicting a method according to one or more embodiments.

FIG. 6 illustrates a flowchart depicting a method 600 according to one or more embodiments. Method 600 may be performed by various components described above with respect to cement evaluation system 100 and FIG. 1, and/or by various components described above with respect to drilling system 200 and FIG. 2. In various embodiments, at least some portion of the steps included in method 600 may be performed by the acoustic transducer arrays illustrated and described above with respect to FIGS. 3A, 3B, 4A, and 4B. In various embodiments, some or all of the method steps included in method 600 may be performed by the electronics system 500 as illustrated and described above with respect to FIG. 5.

Referring to FIG. 6, embodiments of method 600 include disposing a downhole tool into a wellbore, wherein the downhole tool comprises an acoustic transducers array having a plurality of electroacoustic elements arranged circumferentially about an outer surface of the downhole tool (block 601).

Embodiments of method 600 include determining an eccentering vector of the downhole tool with respect to the casing (block 602).

Embodiments of method 600 include determining, at a radial oriented plane of the first acoustic transducer array, a casing center based on the eccentering vector (block 603).

Embodiments of method 600 include choosing a first active aperture, wherein the first active aperture comprises a first set of the plurality of electroacoustic elements (block 604).

Embodiments of method 600 include determining a first midpoint of the first active aperture based on the casing center (block 605).

Embodiments of method 600 include determining a first relative standoff from the first midpoint (block 606).

Embodiments of method 600 include determining first beam-forming parameters based on the first relative standoff, the first midpoint, and the casing center (block 607).

Embodiments of method 600 include exciting the first set, based on the first beam-forming parameters, to output a first synthesized acoustic pulse (block 608).

Embodiments of method 600 include receiving, via the first set, a first acoustic reflection (block 609).

Embodiments of method 600 include determining an acoustic impedance of material behind the casing based on the first acoustic reflection (block 610).

While the aspects of the disclosure are described with reference to various implementations and exploitations, it will be understood that these aspects are illustrative and that the scope of the claims is not limited to them. In general, techniques for producing the synthesized pulse by beamforming as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Terminology

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

Example embodiments include the following.

Embodiment 1. A method comprising: disposing a downhole tool into a wellbore, wherein the wellbore is at least partially lined with a casing, and wherein the downhole tool comprises an acoustic transducers array having a plurality of electroacoustic elements arranged circumferentially about an outer surface of the downhole tool; determining an eccentering vector of the downhole tool with respect to the casing; determining, at a radial oriented plane of the acoustic transducer array, a casing center based on the eccentering vector; choosing a first active aperture, wherein the first active aperture comprises a first set of the plurality of electroacoustic elements; determining a first midpoint of the first active aperture based on the casing center; determining a first relative standoff from the first midpoint; determining first beam-forming parameters based on the first relative standoff, the first midpoint, and the casing center; exciting the first set, based on the first beam-forming parameters, to output a first synthesized acoustic pulse; receiving, via the first set, a first acoustic reflection; and determining an acoustic impedance of material behind the casing based on the first acoustic reflection.

Embodiment 2. The method of embodiment 1, wherein the first set has first subset of electroacoustic elements and a second subset of electroacoustic elements, wherein the first subset is located on a first side of the first midpoint, wherein the second subset is located on a second side of midpoint, and wherein the first subset and the second subset have an equal number of electroacoustic elements.

Embodiment 3. The method of any one of embodiments 1 to 2, further comprising: choosing a second active aperture, wherein the second active aperture comprises a second set of plurality of electroacoustic elements, and wherein the second set includes at least one different electroacoustic element from the first set; determining a second midpoint of the second active aperture based on the casing center; determining a second relative standoff from the first midpoint; determining second beam-forming parameters based on the second relative standoff, the first midpoint, and the casing center; exciting the second set, based on the second beam-forming parameters and the casing center, to output a second synthesized acoustic pulse; and receiving, via the first set, a second acoustic reflection.

Embodiment 4. The method of any one of embodiments 1 to 3, wherein determining the first midpoint comprises: determining a first radius spanning from the casing center to an inner diameter of the casing based on an azimuthal direction of two centermost electroacoustic elements of the first set; and defining the first midpoint at a point where the first radius intersects the circumference of the acoustic transducer array between the two centermost electroacoustic elements of the first set.

Embodiment 5. The method of any one of embodiments 1 to 4, wherein exciting the first set comprises: determining a normal incidence from the first midpoint based on the first midpoint and the casing center; apply the first beam-forming parameters to adjust at least one of amplitude, time delay, and phase of an acoustic output of each electroacoustic element in the first set based on the normal incidence to produce an adjusted acoustic output; and beamforming the adjusted acoustic output of each electroacoustic element in the first set to form the first synthesized acoustic pulse.

Embodiment 6. The method of any one of embodiments 1 to 5, wherein the receiving, via the first set, the first acoustic reflection comprises: receiving an acoustic reflection at each of the electroacoustic elements in the first set, wherein the acoustic reflection is based on interaction of the first synthesized acoustic pulse with at least one of the casing and the material behind the casing; and apply the first beam-forming parameters to adjust at least one of amplitude, time delay, and phase of the acoustic reflection received at each of the electroacoustic elements in the first set, wherein the adjustment to the acoustic reflection at each of the electroacoustic elements in the first set matches the adjustment of the acoustic output of each particular electroacoustic element in the first set.

Embodiment 7. The method of any one of embodiments 1 to 6, wherein determining the acoustic impedance of the material behind the casing comprises performing a 1D inversion based on the first acoustic reflection.

Embodiment 8. The method of any one of embodiments 1 to 7, further comprising creating a 360° image of the casing and material behind the casing.

Embodiment 9. The method of any one of embodiments 1 to 8, wherein the first set defines a circumferential extent of the first active aperture.

Embodiment 10. The method of any one of embodiments 1 to 9, wherein the first set has between 5 and 30 electroacoustic elements.

Embodiment 11. The method of any one of embodiments 1 to 10, wherein centers of each electroacoustic element of the plurality of electroacoustic elements are spaced at least a half wavelength apart from each other.

Embodiment 12. The method of any one of embodiments 1 to 11, further comprising: exciting the plurality of electroacoustic elements; measuring echo waveforms at each electroacoustic element of the plurality of electroacoustic elements; determining return time delay at each of the electroacoustic elements based on the measured echo waveforms; determining standoff distances from each of the plurality of electroacoustic elements based on the return time delay at each of the electroacoustic elements; and determining a casing radius magnitude based on the standoff distances, wherein the eccentering vector is determined based on the casing radius magnitude and the standoff distances, and wherein the casing center is determined based on the casing radius magnitude and the eccentering vector.

Embodiment 13. The method of embodiment 10, wherein the first relative standoff is determined based on the standoff distances of the each of the electroacoustic elements in the first set.

Embodiment 14. The method of any one of embodiments 1 to 13, further comprising determining the material behind the casing based on a decay of a resonance tail of the first acoustic reflection.

Embodiment 15. The method of any one of embodiments 1 to 14, wherein cement is at least partially disposed between an outer surface of the casing and a sidewall of the wellbore, the method further comprising evaluating the cement based on the 360° image.

Embodiment 16. The method of any one of embodiments 1 to 16, wherein the electroacoustic elements are piezoelectric elements.

Embodiment 17. A system comprising: a first acoustic transducer array having a plurality of electroacoustic elements arranged circumferentially about an outer surface of a downhole tool; a processor; and a computer-readable medium having instructions stored thereon that are executable by the processor to cause the system to, determine an eccentering vector of the downhole tool with respect to a casing in which the downhole tool is disposed, wherein the casing lines a wellbore; determine, at a radial oriented plane of the first acoustic transducer array, a casing center based on the eccentering vector; choose a first active aperture, wherein the first active aperture comprises a first set of the plurality of electroacoustic elements; determine a first midpoint of the first active aperture based on the casing center; determine a first relative standoff from the first midpoint; determine first beam-forming parameters based on the first relative standoff, the first midpoint, and the casing center; excite the first set, based on the first beam-forming parameters, to output a first synthesized acoustic pulse; receive, via the first set, a first acoustic reflection; and determine an acoustic impedance of material behind the casing based on the first acoustic reflection.

Embodiment 18. The system of embodiment 17, further comprising a plurality of sensor electronics coupled to the processor and to each element of the plurality of electroacoustic elements to control.

Embodiment 19. The system of any one of embodiments 17 or 18, wherein a number of sensor electronics and a number of electroacoustic elements are equal.

Embodiment 20. The system of any one of embodiments 17 or 18, wherein a number of sensor electronics is less than a number of electroacoustic elements.

Embodiment 21. The system of any one of embodiments 17 to 20, wherein centers of each electroacoustic element of the plurality of electroacoustic elements are spaced at least a half wavelength apart from each other.

Embodiment 22. The system of embodiment 21, wherein the centers are at least 1.5 mm apart.

Embodiment 23. The system of any one of embodiment 17 to 22, further comprising a second acoustic transducer array axially adjacent the first acoustic transducer array.

Embodiment 24. The system of any one of embodiment 17 to 23, wherein the electroacoustic elements are piezoelectric elements.

Embodiment 25. A non-transitory, computer-readable medium having instructions stored thereon that are executable by a computing device to perform operations comprising: determining an eccentering vector of a downhole tool with respect to a casing, wherein the downhole tool is disposed into a wellbore, wherein the wellbore is at least partially lined with the casing, and wherein the downhole tool comprises an acoustic transducers array having a plurality of electroacoustic elements arranged circumferentially about an outer surface of the downhole tool; determining, at a radial oriented plane of the acoustic transducer array, a casing center based on the eccentering vector; choosing a first active aperture, wherein the first active aperture comprises a first set of the plurality of electroacoustic elements; determining a first midpoint of the first active aperture based on the casing center; determining a first relative standoff from the first midpoint; determining first beam-forming parameters based on the first relative standoff, the first midpoint, and the casing center; exciting the first set, based on the first beam-forming parameters, to output a first synthesized acoustic pulse; receiving, via the first set, a first acoustic reflection; and determining an acoustic impedance of material behind the casing based on the first acoustic reflection.

What is claimed is:

1. A method comprising:

disposing a downhole tool into a wellbore, wherein the wellbore is at least partially lined with a casing, and wherein the downhole tool comprises an acoustic transducers array having a plurality of electroacoustic elements arranged circumferentially about an outer surface of the downhole tool;

determining an eccentering vector of the downhole tool with respect to the casing;

determining, at a radial oriented plane of the acoustic transducer array, a casing center based on the eccentering vector;

choosing a first active aperture, wherein the first active aperture comprises a first set of the plurality of electroacoustic elements;

determining a first midpoint of the first active aperture based on the casing center;

determining a first relative standoff from the first midpoint;

determining first beam-forming parameters based on the first relative standoff, the first midpoint, and the casing center such that a first synthesized acoustic pulse to be transmitted from the first set the plurality of electroacoustic elements maintains a normal incidence relative to a reflecting inner surface of the casing, wherein the first set of the plurality of electroacoustic elements are located at any position circumferentially about the outer surface of the downhole tool and wherein the tool is eccentered within the wellbore;

exciting the first set, based on the first beam-forming parameters, to output the first synthesized acoustic pulse;

receiving, via the first set, a first acoustic reflection; and determining an acoustic impedance of material behind the casing based on the first acoustic reflection.

2. The method of claim 1, wherein the first set has first subset of electroacoustic elements and a second subset of electroacoustic elements, wherein the first subset is located on a first side of the first midpoint, wherein the second subset is located on a second side of midpoint, and wherein the first subset and the second subset have an equal number of electroacoustic elements.

3. The method of claim 1, further comprising:

choosing a second active aperture, wherein the second active aperture comprises a second set of plurality of electroacoustic elements, and wherein the second set includes at least one different electroacoustic element from the first set;

determining a second midpoint of the second active aperture based on the casing center;

determining a second relative standoff from the first midpoint;

determining second beam-forming parameters based on the second relative standoff, the first midpoint, and the casing center;

exciting the second set, based on the second beam-forming parameters and the casing center, to output a second synthesized acoustic pulse; and receiving, via the first set, a second acoustic reflection.

4. The method of claim 1, wherein determining the first midpoint comprises:

determining a first radius spanning from the casing center to an inner diameter of the casing based on an azimuthal direction of two centermost electroacoustic elements of the first set; and defining the first midpoint at a point where the first radius intersects the circumference of the acoustic transducer array between the two centermost electroacoustic elements of the first set.

5. The method of claim 1, wherein exciting the first set comprises:

determining a normal incidence from the first midpoint based on the first midpoint and the casing center;

apply the first beam-forming parameters to adjust at least one of amplitude, time delay, and phase of an acoustic output of each electroacoustic element in the first set based on the normal incidence to produce an adjusted acoustic output; and beamforming the adjusted acoustic output of each electroacoustic element in the first set to form the first synthesized acoustic pulse.

6. The method of claim 5, wherein the receiving, via the first set, the first acoustic reflection comprises:

receiving an acoustic reflection at each of the electroacoustic elements in the first set, wherein the acoustic reflection is based on interaction of the first synthesized acoustic pulse with at least one of the casing and the material behind the casing; and apply the first beam-forming parameters to adjust at least one of amplitude, time delay, and phase of the acoustic reflection received at each of the electroacoustic elements in the first set, wherein the adjustment to the acoustic reflection at each of the electroacoustic elements in the first set matches the adjustment of the acoustic output of each particular electroacoustic element in the first set.

7. The method of claim 1, wherein determining the acoustic impedance of the material behind the casing comprises performing a 1D inversion based on the first acoustic reflection.

8. The method of claim 1, further comprising creating a 360° image of the casing and material behind the casing.

9. The method of claim 1, wherein the first set defines a circumferential extent of the first active aperture.

10. The method of claim 1, wherein centers of each electroacoustic element of the plurality of electroacoustic elements are spaced at least a half wavelength apart from each other.

11. The method of claim 1, further comprising:

exciting the plurality of electroacoustic elements;

measuring echo waveforms at each electroacoustic element of the plurality of electroacoustic elements;

determining return time delay at each of the electroacoustic elements based on the measured echo waveforms;

determining standoff distances from each of the plurality of electroacoustic elements based on the return time delay at each of the electroacoustic elements; and determining a casing radius magnitude based on the standoff distances, wherein the eccentering vector is determined based on the casing radius magnitude and the standoff distances, and wherein the casing center is determined based on the casing radius magnitude and the eccentering vector.

12. The method of claim 1, further comprising determining the material behind the casing based on a decay of a resonance tail of the first acoustic reflection.

13. A system comprising:

a first acoustic transducer array having a plurality of electroacoustic elements arranged circumferentially about an outer surface of a downhole tool;

a processor; and a computer-readable medium having instructions stored thereon that are executable by the processor to cause the system to, determine an eccentering vector of the downhole tool with respect to a casing in which the downhole tool is disposed, wherein the casing lines a wellbore;

determine, at a radial oriented plane of the first acoustic transducer array, a casing center based on the eccentering vector;

choose a first active aperture, wherein the first active aperture comprises a first set of the plurality of electroacoustic elements;

determine a first midpoint of the first active aperture based on the casing center;

determine a first relative standoff from the first midpoint;

determine first beam-forming parameters based on the first relative standoff, the first midpoint, and the casing center such that a first synthesized acoustic pulse to be transmitted from the first set the plurality of electroacoustic elements maintains a normal incidence relative to a reflecting inner surface of the casing, wherein the first set of the plurality of electroacoustic elements are located at any position circumferentially about the outer surface of the downhole tool and wherein the tool is eccentered within the wellbore;

excite the first set, based on the first beam-forming parameters, to output the first synthesized acoustic pulse;

receive, via the first set, a first acoustic reflection; and determine an acoustic impedance of material behind the casing based on the first acoustic reflection.

14. The system of claim 13, further comprising a plurality of sensor electronics coupled to the processor and to each element of the plurality of electroacoustic elements to control.

15. The system of claim 14, wherein a number of sensor electronics and a number of electroacoustic elements are equal.

16. The system of claim 14, wherein a number of sensor electronics is less than a number of electroacoustic elements.

17. The system of claim 13, wherein centers of each electroacoustic element of the plurality of electroacoustic elements are spaced at least a half wavelength apart from each other.

18. The system of claim 13, further comprising a second acoustic transducer array axially adjacent the first acoustic transducer array.

19. The system of claim 13, wherein the electroacoustic elements are piezoelectric elements.

20. A non-transitory, computer-readable medium having instructions stored thereon that are executable by a computing device to perform operations comprising:

determining an eccentering vector of a downhole tool with respect to a casing, wherein the downhole tool is disposed into a wellbore, wherein the wellbore is at least partially lined with the casing, and wherein the downhole tool comprises an acoustic transducers array having a plurality of electroacoustic elements arranged circumferentially about an outer surface of the downhole tool;

determining, at a radial oriented plane of the acoustic transducer array, a casing center based on the eccentering vector;

choosing a first active aperture, wherein the first active aperture comprises a first set of the plurality of electroacoustic elements;

determining a first midpoint of the first active aperture based on the casing center;

determining a first relative standoff from the first midpoint;

determining first beam-forming parameters based on the first relative standoff, the first midpoint, and the casing center such that a first synthesized acoustic pulse to be transmitted from the first set the plurality of electroacoustic elements maintains a normal incidence relative to a reflecting inner surface of the casing, wherein the first set of the plurality of electroacoustic elements are located at any position circumferentially about the outer surface of the downhole tool and wherein the tool is eccentered within the wellbore;

exciting the first set, based on the first beam-forming parameters, to output the first synthesized acoustic pulse;

receiving, via the first set, a first acoustic reflection; and determining an acoustic impedance of material behind the casing based on the first acoustic reflection.

* * * * *